US006619307B2

(12) United States Patent
Orr

(10) Patent No.: US 6,619,307 B2
(45) Date of Patent: Sep. 16, 2003

(54) GROUND ANCHORS

(76) Inventor: Robert John Orr, 2A Almeria Court, Underwood, Plympton, Devon PL7 1TX (GB)

( * ) Notice: Subject to any disclaimer, the term of this patent is extended or adjusted under 35 U.S.C. 154(b) by 0 days.

(21) Appl. No.: 09/874,767

(22) Filed: Jun. 5, 2001

(65) Prior Publication Data

US 2001/0039769 A1 Nov. 15, 2001

(51) Int. Cl.[7] ..... E04H 15/62; E02D 5/80

(52) U.S. Cl. ..... 135/118; 52/156; 52/162; 52/164; 248/533

(58) Field of Search ..... 52/155–156, 157, 52/162, 164, 4, 23; 135/118; 248/153, 533

(56) References Cited

U.S. PATENT DOCUMENTS

| | | | | | |
|---|---|---|---|---|---|
| 1,304,779 | A | * | 5/1919 | Juelson | 52/164 |
| 1,316,323 | A | * | 9/1919 | Poole | 52/164 |
| 1,773,760 | A | * | 8/1930 | Steinbreder | 135/118 |
| 2,149,081 | A | * | 2/1939 | Wright | 135/118 |
| 2,564,065 | A | * | 8/1951 | Jaden | 248/156 |
| 3,280,829 | A | * | 10/1966 | Glendenning et al. | 135/118 |
| 3,500,598 | A | | 3/1970 | Ettinger | |
| 4,026,080 | A | * | 5/1977 | Meikle | 52/159 |
| 4,825,604 | A | * | 5/1989 | Manning | 52/158 |

FOREIGN PATENT DOCUMENTS

| | | | | |
|---|---|---|---|---|
| GB | 119116 | | 9/1918 | |
| GB | 129762 | | 7/1919 | |
| GB | 180798 | | 6/1922 | |
| GB | 365517 | | 1/1932 | |
| GB | 977279 | | 12/1964 | |
| GB | 2.30613 | * | 4/1980 | 52/158 |
| GB | 2 216 559 A | | 2/1988 | |
| GB | 2 242 695 A | | 4/1990 | |
| WO | WO 97/32088 | | 2/1997 | |

* cited by examiner

*Primary Examiner*—Lanna Mai
*Assistant Examiner*—Winnie Yip
(74) *Attorney, Agent, or Firm*—Melvin I. Stoltz

(57) ABSTRACT

A ground anchor, such as a tent peg, includes a channel-section, ground-penetrating base member, and a second member at or adjacent one end of the base member. The second member projects (or is capable of projecting) from the base member at an inclination thereto and is provided with an attachment point for a tether.

2 Claims, 2 Drawing Sheets

GROUND ANCHORS

FIELD OF THE INVENTION

This invention relates to devices which can be driven into the ground to provide anchorage points for tethering lines or guy ropes, and more specifically to such devices for use in connection with the guy ropes of tents and marquees. Such devices are referred to herein as ground anchors.

Conventional tent pegs consist of flat pieces of wood which are pointed at one end, with a notch formed in one side of the peg adjacent the other end. Although such pegs are still in use in connection with larger sizes of tents and marquees, they have been replaced for smaller tents, in the interests of lightness and economy of space, by metal skewers, which either have an open eye at one end or are bent over to form a hook.

Such devices, although convenient because they are:

a) light, b) take up little space, and c) do not require a mallet to drive them into the ground, are not entirely satisfactory because they tend to bend and pull out under load, particularly if the ground is soft.

The latter failing applies also to conventional tent pegs because a narrow dimension of the peg is presented to the line of tension of the line attached to the peg.

It is accordingly an object of the present invention to provide an improved ground anchor.

SUMMARY OF THE INVENTION

According to the present invention there is provided a ground anchor comprising a channel-section ground-penetrating base member, and a second member at or adjacent one end of the ground-penetrating base member and projecting (or capable of projecting) therefrom at an inclination to the base of the channel of the ground-penetrating base member, said second member also being of channel section and provided with an attachment point for a tether.

The ground-penetrating base member is preferably pointed at its other end to facilitate penetration thereof into the ground.

The attachment point may be afforded by notches in the side walls of the second channel-section member.

The second member is preferably secured at its one end to the ground-penetrating base member with the notches in the side walls of the second member adjacent the other end thereof.

The second member may be rigidly secured to the ground-penetrating base member so that it projects therefrom at a fixed acute angle to the base of the channel of the ground-penetrating base member.

Alternatively, the second member is pivotally connected to the ground-penetrating base member and is movable between a storage condition, in which it is contained within the side walls of the ground-penetrating base member and an operative position in which it projects at an acute angle to the plane of the base of the channel of the ground-penetrating base member.

The pivotal connection between the second member and the ground-penetrating base member preferably includes stop means to limit the extent of movement of the second member relative to the ground-penetrating base member.

The arrangement is preferably such that, in use, the ground-penetrating base member is forced into the ground at an inclination to the vertical such that the second member is maintained substantially horizontal.

DESCRIPTION OF THE PREFERRED EMBODIMENTS

Figure 1:
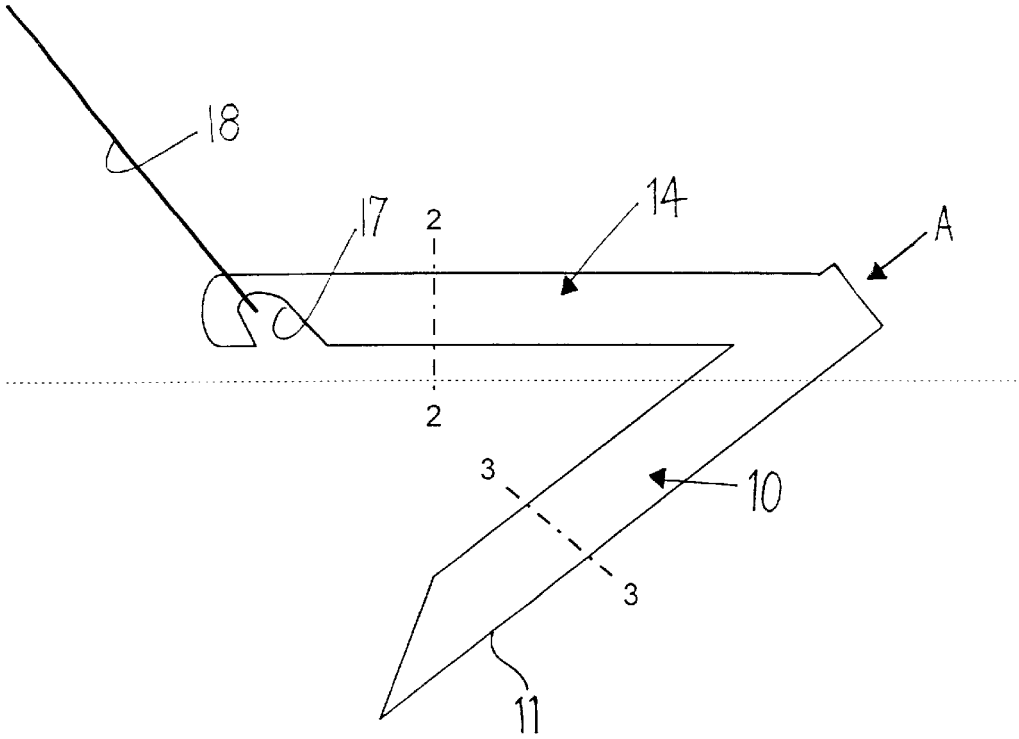
FIG. 1 is a side view of a first form of ground anchor (tent peg) in use.
Figure 2:
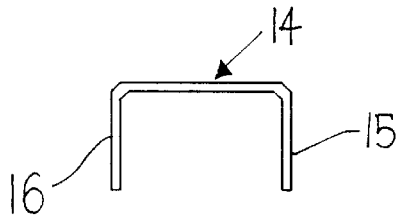
FIG. 2 is a sectional view of the ground anchor (tent peg) of FIG. 1 along the line 2—2 of FIG. 1.
Figure 3:
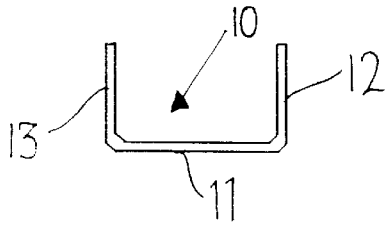
FIG. 3 is a sectional view of the ground anchor (tent peg) of FIG. 1 along the line 3—3 of FIG. 1.

The tent peg shown in FIGS. 1 to 3 includes a channel-section, ground-penetrating base member 10 having a flat surface 11 afforded by the underside of the channel section. The side walls 12 and 13 of the channel section are cut away at one end, as shown in FIG. 1, to facilitate driving of the tent peg into the ground.

At its other end, the channel-section member 10 is welded to one end of a second channel-section member 14. When the tent peg is being driven into the ground, as shown in FIG. 1, the channel of channel-section member 14 faces downwardly. Each of the side walls 15 and 16 of the channel-section member 14 is formed with a notch 17, the two notches 17 being disposed in register adjacent the other end of the second channel-section member 14. The two notches 17 together afford an attachment point for a tethering line 18.

In use, the tent peg is driven into the ground by the application of force (or impacts) as indicated at A to the upper end of the first channel-section member 10 so that the longitudinal axis of the channel-section member 10 is at an angle of the order of 45° to the vertical and so that the longitudinal axis of the second channel-section member 14 is horizontal. The line of action of the force applied by the tethering line 18 to the tent peg will thus be approximately perpendicular to the plane of the flat surface 11. The resistance afforded to the tent peg being pulled out of the ground will thus be substantial.

In the alternative embodiment shown in FIGS. 4 to 6, there is again a channel-section base member 20 having a flat surface 21 afforded by the underside of the channel section. The side walls 22 and 23 of the channel section are cut away at one end, as shown in FIG. 4, to facilitate driving of the tent peg into the ground.

At its other end, the channel-section member 20 is pivotally connected to one end of a second channel-section member 24. Again, when the tent peg is being driven into the ground, as shown in FIG. 4, the channel of channel-section member 24 faces downwardly. Each of the side walls 25 and 26 of the second channel-section member 24 is formed with a notch 27, the two notches 27 being disposed in register adjacent the other end of the second channel-section member 24. The two notches 27 together afford an attachment point for a tethering line 28. The tent peg is again driven into the ground by the application of force (or impacts) applied at B to the upper end of the first channel-section member 20, i.e. as described above in relation to the embodiment shown in FIGS. 1 to 3.

Figure 4:
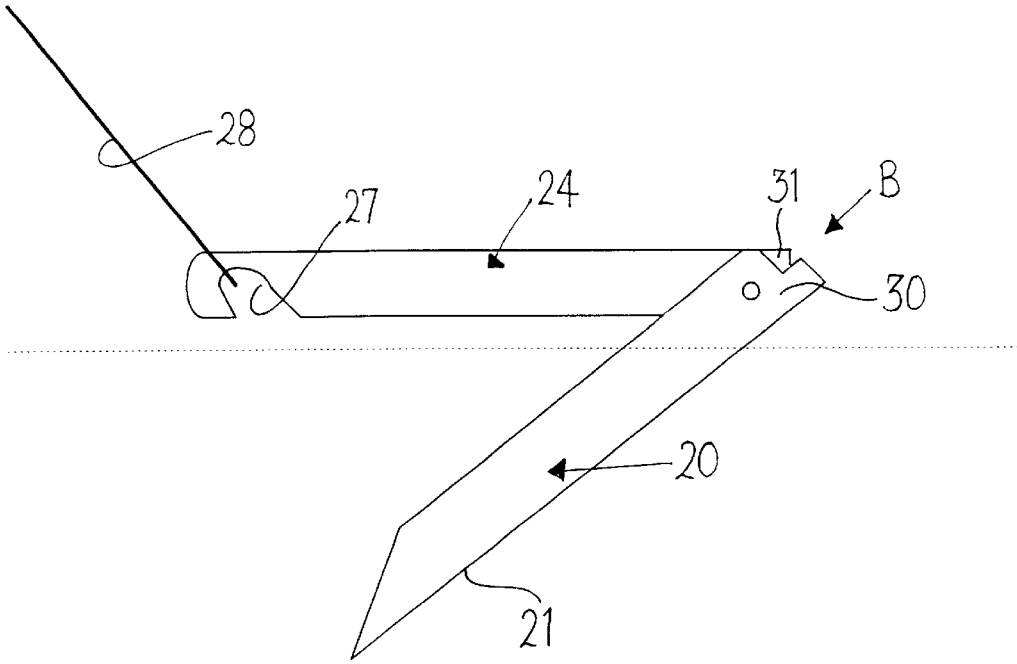
FIG. 4 is a side view of a second form of ground anchor (tent peg) in use.
Figure 5:
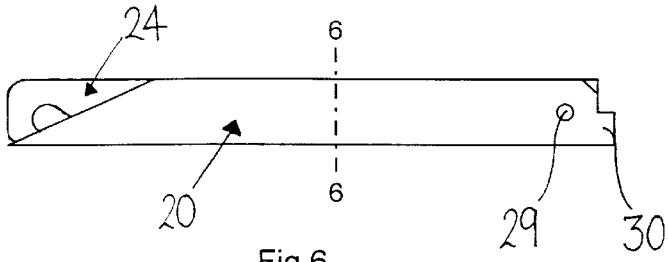
FIG. 5 is a side view of the second form of ground anchor (tent peg) in its folded, storage condition.
Figure 6:
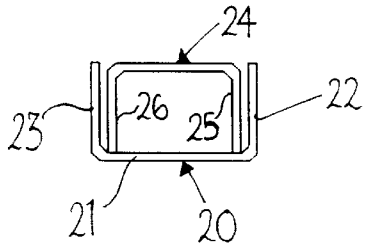
FIG. 6 is a sectional view of the second form of ground anchor along the line 6—6 of FIG. 5.

The second channel-section member 24 is movable relative to the first channel-section member 20 about the axis of a pivot pin 29 between an operative position, as shown in FIG. 4, and a transport or storage position, as shown in FIGS. 5 and 6. When moving the channel-section member 24 out of its storage position, angular movement about the axis of the pivot pin 29 is continued until the operative position is reached in which stop means on the two channel-section members 20 and 24 are in abutting engagement and further angular movement of the second channel-section member 24 relative to the first channel-section member 20 is prevented. The stop means comprise an increased thickness portion 30 of the base of the first channel-section member 20 and a co-operating increased thickness portion 31 of the base of the second channel-section member 24.

The tent peg of FIGS. 4 to 6 is thus used in the same way as that of FIGS. 1 to 3, but has the advantage that it occupies substantially less space when in its folded condition, as shown in FIG. 5.

What is claimed is:

1. A ground anchor comprising:

A. a channel-section ground-penetrating base member which, in use, is inclined to the vertical and has a flat undersurface and upwardly extending side walls that are cut away at the lower end of the base member to provide a ground-penetrating point, and B. a second channel-section member secured at its first end to the upper end of the base member, said second channel-section member extending at an acute angle to the base member and having downwardly extending side walls, said downwardly extending to provided an attachment point for a tether.

2. A ground anchor as claimed in claim 1, in which the second channel-section member is secured rigidly to the base member, said second channel-section member having a second end remote from the first end thereof and the notches that provide the attachment point being located adjacent the second end of the second channel-section member.

* * * * *